US006536154B1

(12) United States Patent
Norris

(10) Patent No.: US 6,536,154 B1
(45) Date of Patent: Mar. 25, 2003

(54) LO-PRO SLING SWIVEL

(75) Inventor: Larry A. Norris, Hillsboro, OR (US)

(73) Assignee: Michaels of Oregon Co., Oregon City, OR (US)

( * ) Notice: Subject to any disclaimer, the term of this patent is extended or adjusted under 35 U.S.C. 154(b) by 0 days.

(21) Appl. No.: 09/949,114

(22) Filed: Sep. 7, 2001

(51) Int. Cl.[7] ..... F41C 23/02
(52) U.S. Cl. ..... 42/85; 24/265; 24/2.5
(58) Field of Search ..... 42/85; 24/2.5, 24/265, 265 AL, 265 WS; 224/913, 150, 931; 403/94, 96, 97, 99, 98, 101

(56) References Cited

U.S. PATENT DOCUMENTS

| | | | | | |
|---|---|---|---|---|---|
| 980,269 | A | | 1/1911 | Hunold | |
| 1,088,314 | A | | 2/1914 | Wilcke | |
| 1,309,431 | A | | 7/1919 | Badger | |
| 1,913,841 | A | | 6/1933 | Lowe | |
| 2,078,010 | A | | 4/1937 | Meepos | 42/85 |
| 2,190,268 | A | | 2/1940 | Magid | 59/95 |
| 2,296,733 | A | | 9/1942 | Paolino | 42/35 |
| 2,771,699 | A | | 11/1956 | Herter | 42/85 |
| 3,061,965 | A | | 11/1962 | Lewis | 42/85 |
| 3,704,537 | A | | 12/1972 | McKinzie | 42/85 |
| 3,914,831 | A | * | 10/1975 | Steinberg | 24/265 AL |
| 4,019,708 | A | * | 4/1977 | Croup | 248/137 |
| 4,209,157 | A | | 6/1980 | Edmisten | 248/360 |
| 4,299,343 | A | | 11/1981 | Atchisson | 224/149 |
| 4,454,675 | A | | 6/1984 | Ives | 42/85 |
| 4,475,854 | A | * | 10/1984 | Ericsson | 188/82.7 |
| 4,505,012 | A | | 3/1985 | Johnson | 24/643 |
| 4,584,858 | A | | 4/1986 | Wolter | 70/456 R |
| 4,823,443 | A | * | 4/1989 | Waters | 24/68 CD |
| 4,841,658 | A | | 6/1989 | Katsenes | 42/85 |
| 4,880,331 | A | * | 11/1989 | Zun | 403/24 |
| 4,913,608 | A | * | 4/1990 | Royball | 254/218 |
| 5,018,652 | A | | 5/1991 | Holtzclaw, Jr. | 224/150 |
| 5,067,267 | A | | 11/1991 | Ives | 42/85 |
| 5,074,069 | A | | 12/1991 | Shire | 42/85 |
| 5,148,582 | A | | 9/1992 | Dennis, Jr. | 24/625 |
| 5,279,060 | A | | 1/1994 | Watson | 42/96 |
| 5,325,618 | A | | 7/1994 | Turner | 42/85 |
| 5,433,360 | A | | 7/1995 | Rock | 224/258 |
| 5,440,787 | A | | 8/1995 | Figueroa et al. | 24/50 |
| 5,517,839 | A | * | 5/1996 | Parsons | 24/2.5 |
| 5,642,584 | A | | 7/1997 | Riggenbach | 42/85 |
| 5,669,118 | A | | 9/1997 | Frano et al. | 42/85 |
| 5,692,654 | A | | 12/1997 | Bell | 224/150 |
| 5,802,756 | A | | 9/1998 | Hightower | 42/85 |
| 5,850,675 | A | * | 12/1998 | Bourquin et al. | 24/265 B |
| 6,112,448 | A | | 9/2000 | Gray et al. | 42/94 |
| 6,178,600 | B1 | | 1/2001 | French | 24/25 |
| D444,201 | S | | 6/2001 | Norris | D22/108 |
| 6,322,279 | B1 | * | 11/2001 | Yamamoto et al. | 224/324 |

* cited by examiner

*Primary Examiner*—Charles T. Jordan
*Assistant Examiner*—Denise J Buckley
(74) *Attorney, Agent, or Firm*—Stoel Rives LLP

(57) ABSTRACT

A quick-detachable sling swivel comprises a body and a shift/swing gate mounted on the body through an elongated plunger. The gate, through manipulation of the plunger, is adjustable between open and closed positions relative to the body to enable mounting, demounting and securing of the swivel relative to an external structure.

20 Claims, 2 Drawing Sheets

LO-PRO SLING SWIVEL

BACKGROUND OF THE INVENTION

The present invention relates to quick-detachable swivels for attaching a sling to an item to be carried or pulled, such as a firearm or luggage.

Quick-detachable swivels have been known in the art for some time. In general, such swivels have a loop at one end of a body for attachment to a sling, and a mounting pin that is receivable by a conventional mounting base or swivel stud attached to a firearm. Two examples of sling swivels are disclosed in Ives, U.S. Pat. No. 4,454,675, and Ives, U.S. Pat. No. 5,067,267. In those swivels, the loop is fashioned from a piece of wire having a circular cross section that is bent to form the loop, so that the loop has curved sides. The two ends of the loop are then inserted into the body to attach the loop to the body.

Another sling swivel, sold by Boonie Packer of Salem, Oreg., is made from injection molded metal so that the loop portion is integral with the body. The Boonie Packer loop has the same curved sides and circular cross-section as the loop of the swivels disclosed in the two Ives patents discussed above.

Yet another sling swivel manufactured by Boonie Packer of Salem, Oreg., is formed by bending a wire having a rectangular cross-section to form a loop having curved outer portions, like that of the Boonie Packer injection molded sling swivel and the swivels disclosed in the two Ives patents. Instead of having a solid body, the two end portions of the wire extend in substantially straight lines away from the loop portion, with the mounting pin extending from one of the end portions.

Because sling swivels are used with firearms, the sling swivels should be sturdy enough so that the sling swivel does not break or detach and allow the firearm to become disengaged from the sling. Nevertheless, it is also desired that the sling swivel be quickly detachable, so that the firearm may be quickly removed from the sling when desired. It is also desired that the sling swivel be quiet, especially in hunting situations. Many sling swivels are formed from metal. These swivels may produce unwanted noise in use when the metallic sling swivel strikes the firearm, particularly metallic portions of the firearm such as the barrel.

Accordingly, what is still desired is a sling swivel that is quick-detachable, that has a loop portion for attaching to a sling but that is relatively quiet, that has a shift/swing gate that resists opening when subjected to stress, that is relatively light weight, and that is easily and cheaply manufactured.

BRIEF SUMMARY OF THE INVENTION

The present invention overcomes the aforesaid drawbacks of the prior art and provides an improved quick-detachable sling swivel. In a first aspect of the invention, the quick-detachable sling swivel of the present invention connects a sling to a mounting base. The sling swivel comprises a body and a shift/swing gate. The body has an elongate bore and an offset arm. An elongate plunger is mounted in the bore of the body and defines a plunger axis. The plunger is movable axially between a first and a second position with respect to the body. The shift/swing gate is associated with the body through the plunger, the gate being rotatable when the plunger is in the second position, and the gate being capable of interconnecting with the offset arm when the plunger is in the first position. The body, the gate and the offset arm collectively define a loop for receiving the sling when the gate is interconnected with the offset arm. When the sling swivel is attached to the mounting base, the sling is received within the loop.

This aspect of the invention has the advantage of providing a quiet sling swivel that is small, lightweight and quick detachable. The sling swivel is quieter than conventional swivels because the fabric sling covers at least a portion of the body. Thus, the sling insulates the sling swivel, and reduces the amount of contact that may occur between the sling swivel and the firearm or other item to which the sling swivel is attached.

In another separate aspect of the invention, a sling swivel comprises a body and a shift/swing gate. The body has an elongate bore and an offset arm. An elongate plunger is mounted in the bore of the body and defines a plunger axis, the plunger being movable axially between first and second positions with respect to the body. The shift/swing gate is associated with the body through the plunger. The gate is rotatable when the plunger is in the second position, the gate being capable of interconnecting with the offset arm when the plunger is in the first position. The gate and body have respective engaging surfaces which selectively interfere with rotation of the gate with respect to the body. When the plunger is in the first position, the respective engaging surfaces prevent rotation of the gate with respect to the body. When the plunger is in the second position, the respective engaging surfaces are spaced apart from each other, thus allowing the gate to rotate with respect to the body.

This aspect of the invention provides a sling swivel that is both quick-detachable and securely locked. The mating engaging surfaces act to prevent rotation of the gate with respect to the body when the gate is interconnected with the arm and the mounting pin is inserted through the mounting base. This further reinforces the gate in the closed position, allowing the sling swivel to withstand twisting forces and reducing the amount of stress applied to the mounting pin when engaged with the gate.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
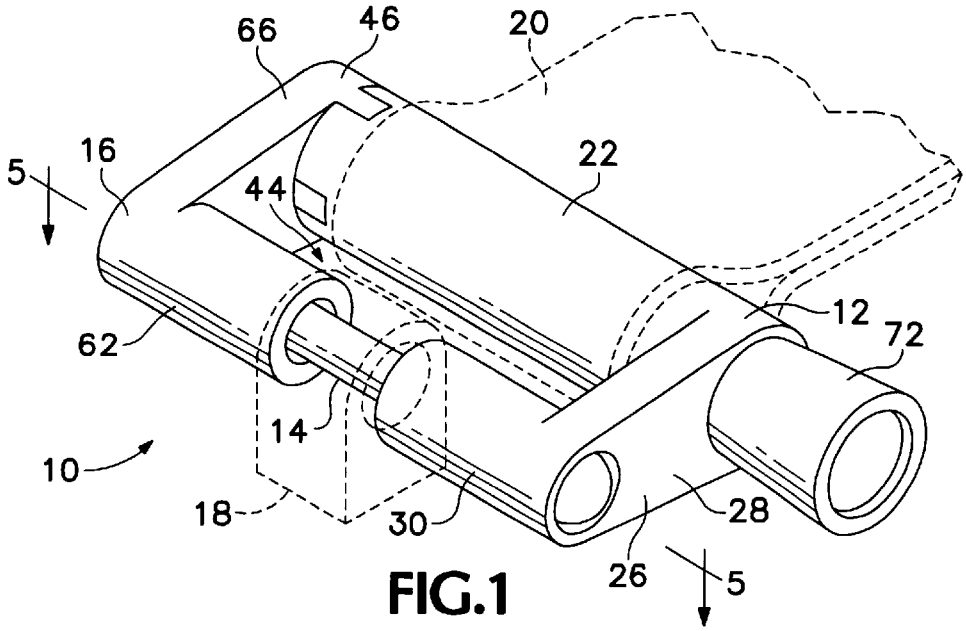
FIG. 1 is a perspective view of an exemplary sling swivel of the present invention attached to a sling, with the sling shown in fragmentary view, and in which the shift/swing gate is in the closed position.

Referring now to the drawings wherein like numerals refer to like elements, FIG. 1 shows a sling swivel 10 that is one embodiment of a locking quick-detachable swivel constructed in accordance with the present invention. In general terms, the sling swivel 10 includes a body 12 which carries a mounting pin 14 that coacts with a shift/swing gate 16. The swivel 10 detachably connects a sling to a mounting base. For example, FIG. 1 shows the swivel 10 interconnecting a mounting base 18 with a sling 20. The mounting base 18 may be any device having a bore capable of receiving the mounting pin 14 and which may be secured to an item. For example, the mounting base 18 may be a conventional swivel stud. The sling 20 may be any conventional sling or strap formed from fabric, leather or other suitable material. For example, swivel 10 may connect a firearm sling to a firearm stock through the use of a conventional mounting base or swivel stud 18 that is attached to the firearm, and which includes a suitable bore that receives mounting pin 14. The sling swivel 10 may also be used to connect a sling or strap to luggage or other items to which a mounting base or swivel stud may be attached.

The body 10 has an elongate sling retaining section 22 having a longitudinal bore 24 therethrough. In use, the sling 20 passes around the retaining section 22 as shown in FIG. 1. Thus, the sling retaining section should be sufficiently rigid to withstand pulling forces applied by the sling 20 to the sling swivel 10. In addition, the sling retaining section 22 is preferably smoothly contoured to allow the sling to slide smoothly against the outer surface. One preferred shape is a cylindrical shape for the sling retaining section 22. The body 12 also includes an offset arm 26 which has a first section 28 that extends away from the elongate sling retaining section 22, and a second section 30 that is roughly parallel to the elongate sling retaining section 22. In the embodiment depicted in FIG. 1, the mounting pin 14 is mounted to this second section 30 and is thus part of the offset arm 26. Alternatively, the mounting pin 14 could be mounted to the shift/swing gate 16.

Figure 2:
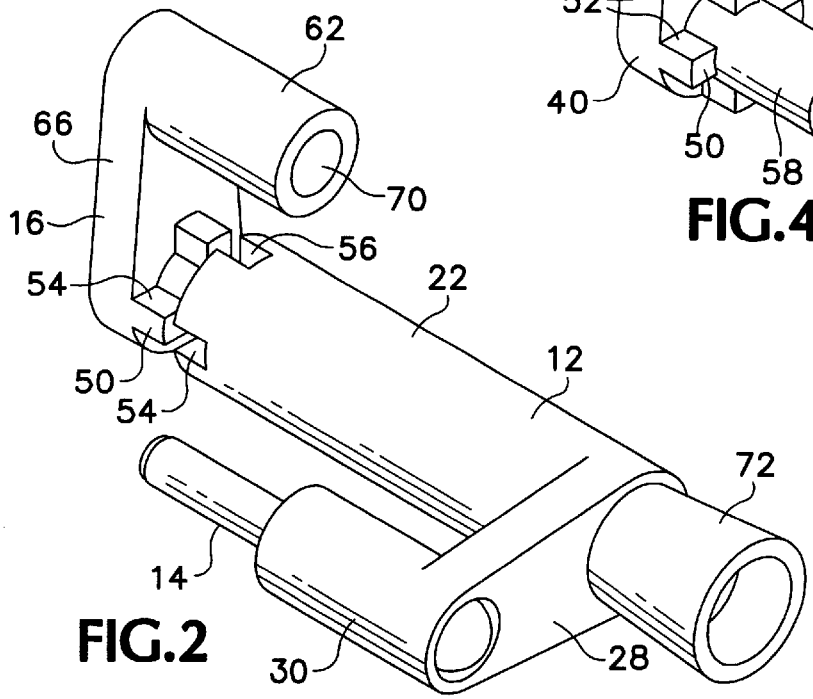
FIG. 2 shows the sling swivel of FIG. 1, but with the shift/swing gate in an open position so that the mounting pin is free to receive a swivel stud.
Figure 5:
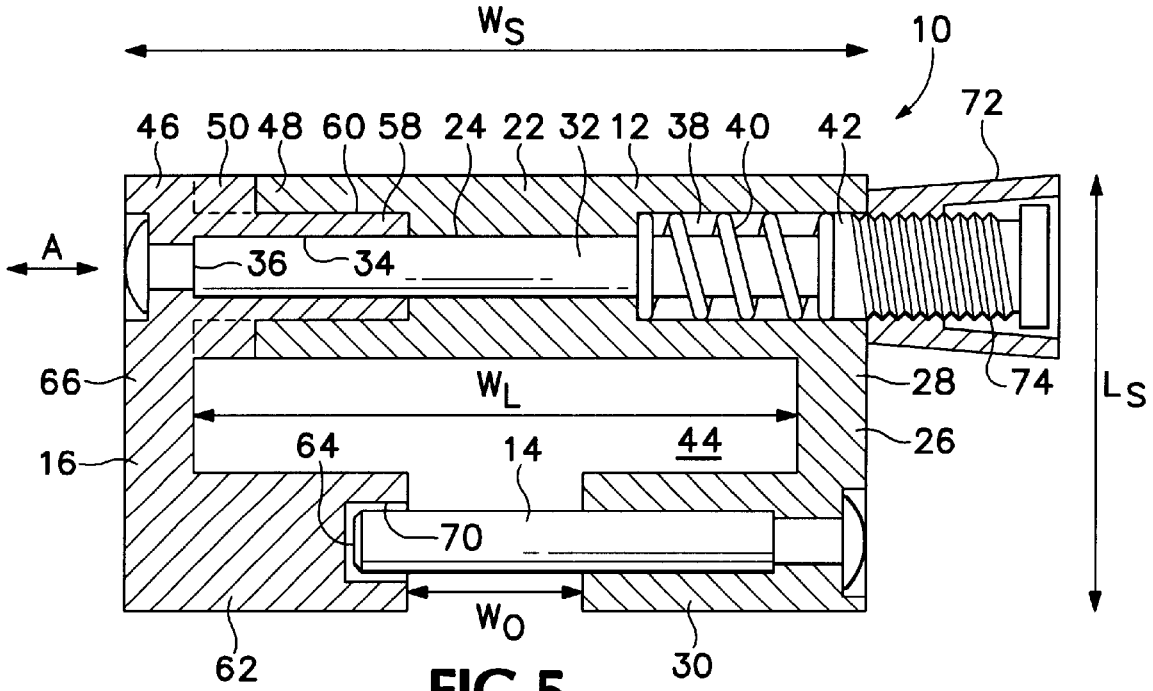
FIG. 5 is a cross-sectional view of the sling swivel taken along the line 5—5 of FIG. 1.
Figure 6:
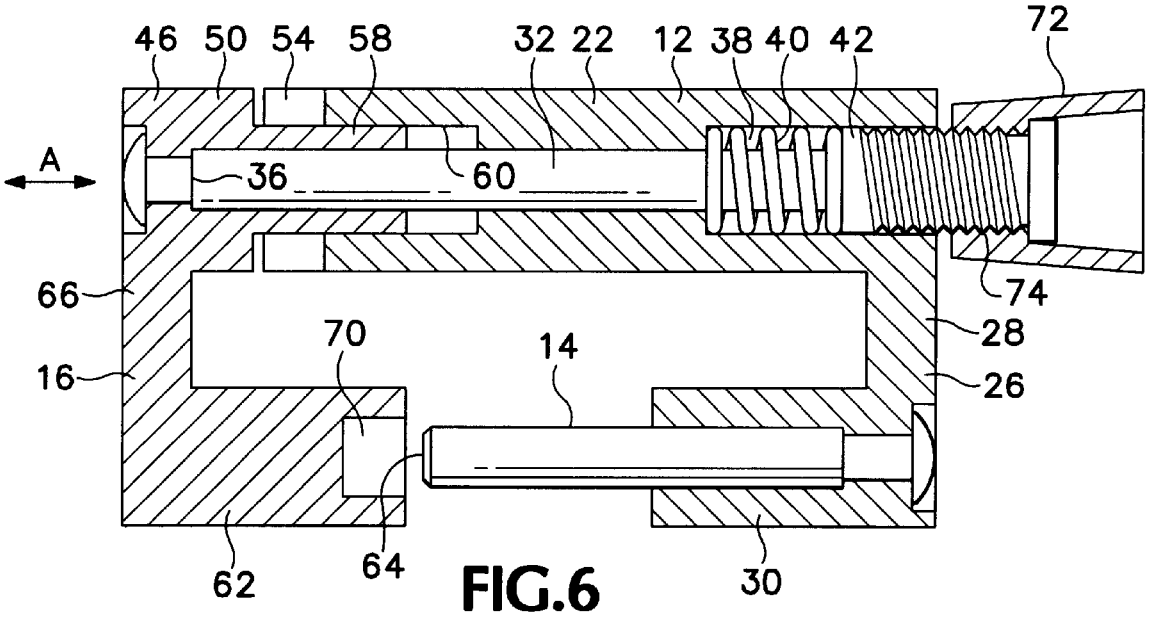
FIG. 6 is a cross-sectional view like that of FIG. 5 but showing the plunger moved so as to shift the gate to a position where the gate may be rotated.

The shift/swing gate 16 interconnects with the offset arm 26 to secure the sling swivel 10 to a mounting base 18 when the pin 14 is received in the bore of the mounting base. The shift/swing gate 16 and body 12 together operate as follows. Gate 16 is fixedly joined at one end of a spring-biased plunger 32. The plunger 32 defines a longitudinal axis A about which the plunger may rotate. As shown particularly in FIGS. 5 and 6, the gate 16 has a bore 34 for receiving an end 36 of the plunger 32. The plunger 32 is received within the bore 24 of the body 12. The bore 24 has an enlarged cavity 38 at one end containing a biasing spring 40. The biasing spring 40 presses against the body 12 and an enlarged section 42 of the plunger 32 to urge the plunger 32 longitudinally rightward along the axis A as shown in FIGS. 1 and 5, together with the gate 16. The gate 16 is capable of being rotated about the axis A of plunger 32 from an open to a closed position when the plunger 32 is moved far enough to the left as shown in FIGS. 2 and 6. In the open position, shown in FIG. 6, the gate 16 may be swung away from the mounting pin 14 to the position shown in FIG. 2 so that the mounting pin 14 may receive or be removed from the bore of a mounting base. In a closed position, the gate 16 engages the mounting pin 14 so that the mounting pin 14 may not be withdrawn from the bore. The gate 16, through manipulation of the plunger 32, is thus adjustable between open and closed positions relative to the body 12 to enable mounting, demounting and securing of the swivel 10 relative to an external structure.

Collectively, the gate 16, elongate sling retaining section 22, and offset arm 26 define a loop having an opening 44 for receiving a sling 20. For example, FIG. 1 shows the sling 20 in phantom lines disposed about the sling retaining section 22 and through the opening 44. This arrangement is in contrast to conventional sling swivels, in which the sling swivel has a separate loop at the end of the body for receiving the sling. The arrangement of the present invention provides several advantages over such conventional sling swivels. The sling swivel 10 is quieter in use, since the sling 20 covers and insulates the body from the firearm (or other device) to which the sling swivel 10 is connected. In addition, the sling swivel requires less material to produce, since the openings to receive the mounting base and sling are combined into a single loop.

In most applications, the sling 20 is wider, than the width of the mounting base 18. Thus, it is desired that the loop have a longitudinal width ($W_L$) that is greater than the width of the mounting base. Thus, it is preferred that the interior width of the loop $W_L$ is greater than the width of the opening ($W_O$) between the gate 16 and the offset arm 26 for receiving the mounting base 18. (See FIG. 5.) Preferably, the width $W_L$ is at least 2-fold the width of the opening $W_O$. That is, if the width $W_O$ is ¼ inch, then the width $W_L$ is at least ½ inch. It is also desired that the sling swivel be relatively compact. Thus, while the opening 44 is sufficiently large to accommodate the sling, nevertheless, it is desired that the opening is relatively narrow. In one embodiment the swivel defines an overall width $W_S$, and an overall length $L_S$. (See FIG. 5.) Preferably, the overall width $W_S$ of the sling swivel is greater than the overall length of the sling swivel. In such a case, the resulting sling swivel is very compact and light weight.

Figure 3:
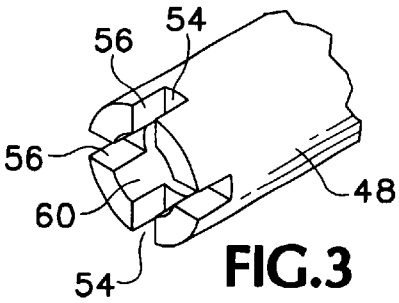
FIG. 3 is a partial view of the end of the body of the sling swivel.
Figure 4:
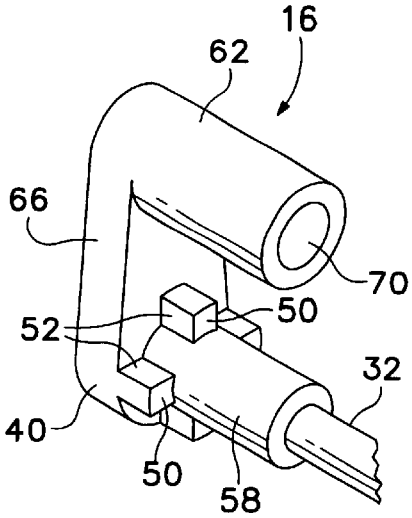
FIG. 4 is a partial view of the gate and plunger.

The gate 16 and body 12 may also include interlocking structure to restrict rotation of the gate 16 with respect to the body 12 when the plunger 32 is in the first position (i.e., the gate is closed). Referring particularly to FIGS. 3 and 4, the gate has an end 46 having several projections which engage notches in the end 48 of the sling retaining section 22. As shown in FIG. 4, the end 46 of the gate 16 has a plurality of longitudinally extending rails 50 that are located about the exterior of the end 46. Each of these rails 50 provides a pair of engaging surfaces 52, which are oriented such that the normal of the surface 52 is not aligned with the rotational axis A of the plunger 32, and is preferably perpendicular to the rotational axis A. Turning to FIG. 3, the end 48 of the sling retaining section 22 has corresponding notches or slots 54 for receiving the respective rails 50 of the end 46 of the gate 16. These slots 54 also have respective engaging surfaces 56. The engaging surfaces 56 of the slots 54 oppose the engaging surfaces 52 of the rails 50 when the plunger 32 is in the first position (as illustrated in FIG. 1) so that the gate 16 is prevented from rotating with respect to the body 12. In the embodiment depicted in the figures, the gate 16 has four rails 50, while the sling retaining section 22 has four corresponding slots 54. This allows the gate 16 to engage the body at four different positions which are rotationally offset from each other by 90 degrees.

Alternatively, other interlocking or engaging structures may be used. For example, more or fewer rails or slots may be used. The projections and corresponding notches or slots may also be shaped differently. For example, instead of rails having rectangular surfaces, the projections on the gate 16 may be tapered, wedge shaped, or in the form of a saw-tooth, and the notches in the end of the sling retaining section 22 may be shaped correspondingly to receive the projections. As yet another alternative, the notches may instead be formed in the gate 16, while the end 48 of the sling section 22 may have corresponding projections which are inserted into and engage the notches in the gate.

The gate 16 may also have a thick, cylindrical extension 58 for attachment to the plunger 32, which may be inserted into a corresponding cavity 60 within the body 12. The extension 58 adds support to the plunger 32 when the gate 16 is shifted away from the body 12, so as to reduce or prevent bending of the plunger 32.

Like the offset arm 26, the gate 16 has an offset section 62 for receiving an end 64 of the mounting pin 14. The gate 16 has a section 66 extending away from the sling retaining section, and the offset section 62 is parallel to the sling retaining section 22. At the end of the section 62 is a cavity 70 for securely receiving the end 64 of the mounting pin 14. While the embodiment depicted shows the mounting pin 14 secured to the offset arm 26 and received by the gate 16, alternatively the mounting pin 14 may be mounted to the gate 16 and received by the offset arm 26. Preferably, the section 30 of the arm 26 and section 66 of the gate 16 are thicker than the mounting pin 14 and thicker than the bore of the mounting base 18. In such a case, when the sling swivel 10 is attached to the mounting base 18, the two sections 30 and 66 prevent the sling swivel 10 from sliding laterally with respect to the mounting base 18.

The swivel 10 may also include a locking mechanism comprising an adjustable sleeve 72 for locking the plunger 32 positively and selectively against manipulation thereof to prevent the gate 16 from rotating from a closed to an open position. As shown in FIGS. 5 and 6, the plunger 32 has a threaded end 74 which threadably engages the sleeve 72. Rotation of the sleeve 72 relative to the threaded end 74 allows the sleeve 72 to lock the plunger 32 relative to the body as shown in FIG. 5, or to allow movement of the plunger 32 as shown in FIG. 6. The position-changeable sleeve 72, and the locking mechanism used to place the swivel in locked and unlocked conditions, are more fully disclosed in Ives, U.S. Pat. No. 4,454,675, the disclosure of which is fully incorporated herein by reference. Alternatively, the present invention may be used with the sleeve and attendant locking mechanism disclosed in Ives, U.S. Pat. No. 5,067,267, the disclosure of which is also fully incorporated herein by reference. These locking mechanisms restrict movement of the plunger 32 along its longitudinal axis, thus preventing the plunger 32 from moving far enough away from the body 12 to allow the shift/swing gate 16 to become disengaged from the pin 14. While the locking mechanisms of Ives, U.S. Pat. No. 4,454,675 and Ives, U.S. Pat. No. 5,067,267 are preferred, other mechanical locking mechanisms that lock the gate in the closed position may be used with the present invention.

The swivels 10 of the present invention may be made as follows. The body 12 and gate 16 may be injection molded from metal powder, plastic, or other moldable material. An exemplary material which may be used is a steel metal injection molding compound sold under the trade name MIM 4600, available from Carpenter Parmatech in Petaluma, Calif. An exemplary synthetic material for injection molding is a molding compound sold under the trade name CAPRON 83316H1 available from Allied Signal Plastics in Redmond, Wash. Other materials suitable for injection molding may also be used. The injection molding process may be performed conventionally as is known to persons skilled in the art. The locking mechanism may be fabricated as described in Ives, U.S. Pat. No. 4,454,675 or Ives, U.S. Pat. No. 5,067,267. Alternatively, the sling swivel 10 of the present invention may be machined or made using other conventional metal or plastic fabrication techniques.

While the inventor has found that certain features of the present invention yield certain advantages, the arrangement, dimensions, combination of the various features, and the resulting overall appearance of the sling swivel may be tailored to the aesthetic and ornamental needs of the designer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In combination, a sling swivel connecting a sling to a firearm mounting base, comprising:

(a) said sling swivel having a body defining an elongate bore and having an offset arm;

(b) an elongate plunger mounted in said bore of said body and defining a longitudinal axis, said plunger movable longitudinally along said axis between first and second positions with respect to said body;

(c) a shift/swing gate associated with said body through said plunger, said gate being rotatable with respect to said body when said plunger is in said second position;

(d) a mounting pin being capable of interconnecting said gate with said offset arm when said plunger is in said first position;

(e) said body, said gate and said offset arm collectively defining a loop for receiving said sling when said gate is interconnected with said offset arm; and (f) when said mounting pin is received within a bore of said firearm mounting base, said sling is received within said loop.

2. The combination of claim 1 wherein said mounting pin is attached to said offset arm.

3. The combination of claim 1 wherein said gate and said body have respective engaging surfaces to resist rotation of said gate when said plunger is in said first position.

4. The combination of claim 3 wherein said gate has a plurality of projections, and said body has a plurality of notches for receiving said rails.

5. The combination of claim 1 wherein said sling swivel defines an overall width and an overall length, and said overall width of said sling swivel is greater than said overall length of said sling swivel.

6. The combination of claim 1 wherein said sling has a first width and said firearm mounting base has a second width, and said first width being greater than said second width.

7. The combination of claim 6 wherein said first width is at least 2-fold said second width.

8. The combination of claim 1 wherein said sling swivel further comprises a locking mechanism comprising a sleeve associated with said plunger, said locking mechanism selectively resisting movement of said plunger longitudinally along said axis.

9. A sling swivel, comprising:

(a) a body having an elongate bore and an offset arm;

(b) an elongate plunger mounted in said bore of said body and defining a longitudinal axis, said plunger movable longitudinally along said axis between first and second positions with respect to said body;

(c) a shift/swing gate associated with said body through said plunger, said gate being rotatable when said plunger is in said second position, said gate being capable of interconnecting with said offset arm when said plunger is in said first position; and (d) at least one of said gate and said body having a projection having an engaging surface, and the other of said gate and said body having a mating notch having an opposing engaging surface, said respective engaging surfaces preventing rotational movement of said gate with respect to said body when said plunger is in said first position, and said respective engaging surfaces being out of engagement when said plunger is in said second position.

10. The sling swivel of claim 9 wherein said gate has a plurality of projections, and said body has a plurality of notches for receiving said projections.

11. The sling swivel of claim 9 wherein said offset arm further comprises a mounting pin.

12. The sling swivel of claim 9 wherein said sling swivel defines an overall width and an overall length, and said overall width of said sling swivel is greater than said overall length of said sling swivel.

13. The sling swivel of claim 9 wherein said body, said gate and said offset arm collectively define a loop for receiving a sling when said gate is interconnected with said offset arm.

14. The sling swivel of claim 13 wherein said loop has a first width in a longitudinal direction and said gate and said offset arm define an opening for receiving a mounting base having a second width in said longitudinal direction, and said first width is greater than said second width.

15. The sling swivel of claim 14 wherein said first width is at least 2-fold said second width.

16. The sling swivel of claim 9 further comprising a locking mechanism comprising a sleeve associated with said plunger, said locking mechanism selectively resisting movement of said plunger longitudinally along said axis.

17. A method for attaching a sling to a firearm mounting base, comprising:

(a) providing a sling swivel having a body defining an elongate bore and having an offset arm;

(b) mounting an elongate plunger in said bore of said body, said plunger defining a longitudinal axis, and said plunger being movable longitudinally along said axis between first and second positions with respect to said body;

(c) providing a shift/swing gate associated with said body through said plunger, said gate being rotatable about said axis when said plunger is in said second position;

(d) providing a firearm mounting pin capable of interconnecting said gate with said offset arm when said plunger is in said first position;

(e) said body, said gate and said offset arm collectively defining a loop for receiving said sling when said gate is interconnected with said offset arm; and (f) inserting said mounting pin into a bore of said mounting base and inserting said sling into said loop.

18. The method of claim 17, further comprising providing on at least one of said gate and said body a projection, and providing on the other of said gate and said body a mating notch, and engaging said projection in said notch when said plunger is in said first position.

19. The method of claim 17, further comprising providing a locking mechanism having a sleeve associated with said plunger, said locking mechanism selectively resisting longitudinal movement of said plunger along said axis.

20. The method of claim 17 wherein said sling has a first width, and said base has a second width, and said first width is greater than said second width.

* * * * *

UNITED STATES PATENT AND TRADEMARK OFFICE

CERTIFICATE OF CORRECTION

PATENT NO. : 6,536,154 B1
DATED : March 25, 2003
INVENTOR(S) : Larry A. Norris

It is certified that error appears in the above-identified patent and that said Letters Patent is hereby corrected as shown below:

Column 8,
Line 12, "providing a firearm mounting pin" should read -- providing a mounting pin --.

Signed and Sealed this

Twentieth Day of January, 2004

JON W. DUDAS
*Acting Director of the United States Patent and Trademark Office*